US011686105B2

(12) United States Patent
Beyreuther et al.

(10) Patent No.: US 11,686,105 B2
(45) Date of Patent: Jun. 27, 2023

(54) DOUBLE PLATE FLOOR PANEL

(71) Applicant: Mercer Mass Timber LLC, Vancouver (CA)

(72) Inventors: Todd Beyreuther, Spokane, WA (US); Daniel Koeberl, Graz (AT); Gary Fong, Cupertino, CA (US)

(73) Assignee: Mercer Mass Timber LLC, Vancouver (CA)

( * ) Notice: Subject to any disclaimer, the term of this patent is extended or adjusted under 35 U.S.C. 154(b) by 229 days.

(21) Appl. No.: 17/008,035

(22) Filed: Aug. 31, 2020

(65) Prior Publication Data

US 2021/0062520 A1 Mar. 4, 2021

Related U.S. Application Data

(60) Provisional application No. 62/894,056, filed on Aug. 30, 2019.

(51) Int. Cl.
*E04F 15/04* (2006.01)
*E04F 15/02* (2006.01)

(52) U.S. Cl.
CPC ..... *E04F 15/041* (2013.01); *E04F 15/02044* (2013.01); *E04F 2201/0138* (2013.01); *E04F 2201/0153* (2013.01)

(58) Field of Classification Search
CPC ..... E04F 2203/06; E04F 15/041; E04F 15/02044; E04F 15/046; E04F 15/02133; E04F 15/0215
See application file for complete search history.

(56) References Cited

U.S. PATENT DOCUMENTS

2003/0161994 A1* 8/2003 Je-Suk ..... E04F 15/20 428/138
2019/0119862 A1* 4/2019 Penland, Jr. ..... E01C 5/18

FOREIGN PATENT DOCUMENTS

| | | | | |
|---|---|---|---|---|
| CN | 108049593 A | * | 5/2018 | |
| CN | 110195502 A | * | 9/2019 | ..... E04F 15/02 |
| CN | 110644721 A | * | 1/2020 | ..... E04F 15/02 |
| DE | 10040729 A1 | * | 2/2002 | ..... E04F 15/022 |
| DE | 202007006447 U1 | * | 9/2007 | ..... E01C 11/24 |
| EP | 1197611 A1 | * | 4/2002 | ..... E01C 13/02 |

* cited by examiner

*Primary Examiner* — Babajide A Demuren
(74) *Attorney, Agent, or Firm* — Elliott, Ostrander & Preston, P.C.

(57) ABSTRACT

A double plate floor panel is provided. The double plate floor panel includes a first panel, a second panel, and a plurality of connectors. The first panel has a first plurality of recesses on a first surface, and the second panel has a second plurality of recesses on a second surface. Each connector of the plurality of connectors inserts into a recess of the first plurality of recess and a recess of the second plurality of recesses. The connectors are sandwiched between the first surface of the first panel and the second surface of the second panel. A method of assembling the double plate floor panel is also provided.

18 Claims, 15 Drawing Sheets

DOUBLE PLATE FLOOR PANEL

CROSS REFERENCE TO RELATED APPLICATIONS

This application claims the benefit of U.S. Provisional Application No. 62/894,056 filed on Aug. 30, 2019 for DOUBLE PLATE FLOOR PANEL, which is incorporated by reference as if fully set forth.

FIELD OF INVENTION

The present invention relates generally to the art of building floors, and more specifically to a double plate floor panel and the method of assembly thereof.

BACKGROUND

Floors are subject to vibration. The term vibration refers to oscillatory motion experienced by the building and its occupants during the course of normal day-to-day activity. Vibration may be vertical as well as horizontal. Vibration may be caused by nearby traffic or public transportation, the building's mechanical systems, normal human activity such as walking on the floor, etc. Vibration may be problematic in conventional floor systems even when the floor has sufficient strength. Traditionally, this problem is solved by adding additional mass to the floor through weights or thicker material. However, adding weight to the floor system affects the design of the building structure, such as support beams and posts. The additional weight ultimately results in increased costs and decreased lengths of the floor span.

SUMMARY

A double plate floor panel is provided. The double plate floor panel includes a first panel, a second panel, and a plurality of connectors. The first panel has a first plurality of recesses on a first surface, and the second panel has a second plurality of recesses on a second surface. Each connector of the plurality of connectors inserts into a recess of the first plurality of recess and a recess of the second plurality of recesses. The connectors are sandwiched between the first surface of the first panel and the second surface of the second panel. A method of assembling the double plate floor panel is also provided.

BRIEF DESCRIPTION OF THE DRAWINGS

The foregoing summary, as well as the following detailed description will be better understood when read in conjunction with the appended drawings. For the purpose of illustration, there is shown in the drawings different embodiments. It should be understood, however, that the teachings are not limited to the precise double plate floor panel and floor system shown.

DETAILED DESCRIPTION

Figure 1:
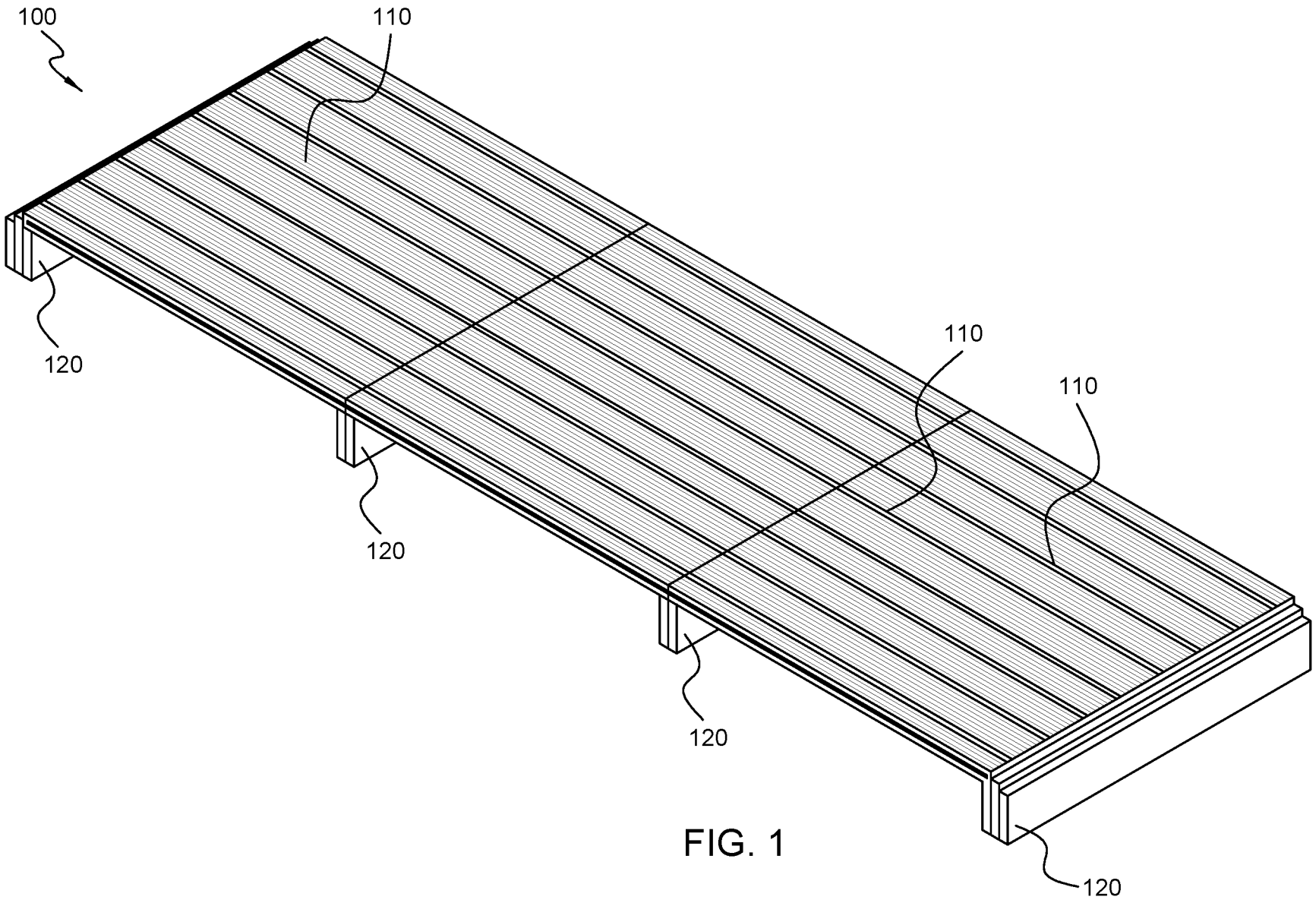
FIG. 1 is a perspective view of a floor system of the present invention.

FIG. 1 shows a perspective view of a floor system 100 of the present invention. The floor system includes double plate floor panels 110. The double plate floor panel 110 is a cost-effective solution to vibration issues in floors. Each double plate floor panel 110 spans between at least two beams 120. The double plate floor panels 110 are supported on opposite ends by the beams 120. FIG. 1 illustrates a floor system 100 with three double plate floor panels 100. However, a floor system 100 may comprise one or more double plate floor panels 110. FIG. 1 also illustrates a floor system 100 with four beams 120. However, a floor system 100 may comprise two or more beams 120. The double plate floor panels 110 are designed to transfer loads to the beams 120. The beams 120 are designed to transfer loads from the double plate floor panels 110 to other building components such as load bearing walls or columns.

Figure 2C:
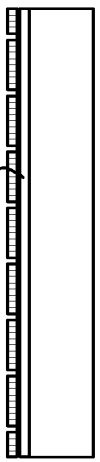
FIG. 2C is a left or right view of the floor system of the present invention.
Figure 2A:
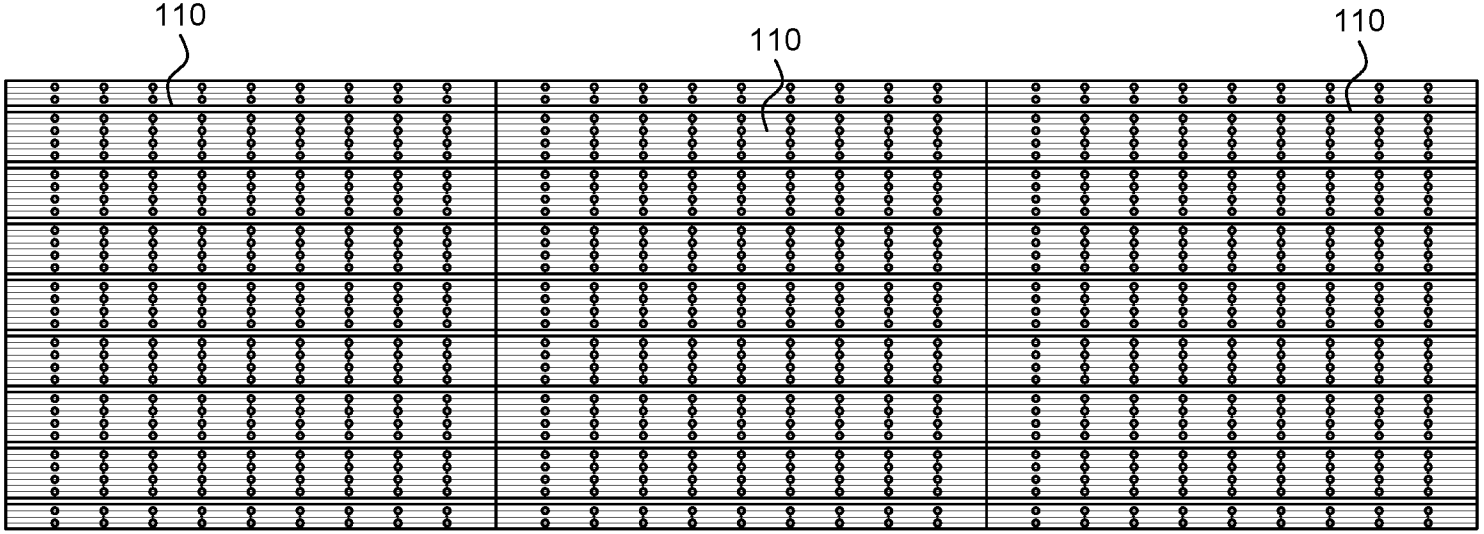
FIG. 2A is a top view of the floor system of the present invention.
Figure 2B:
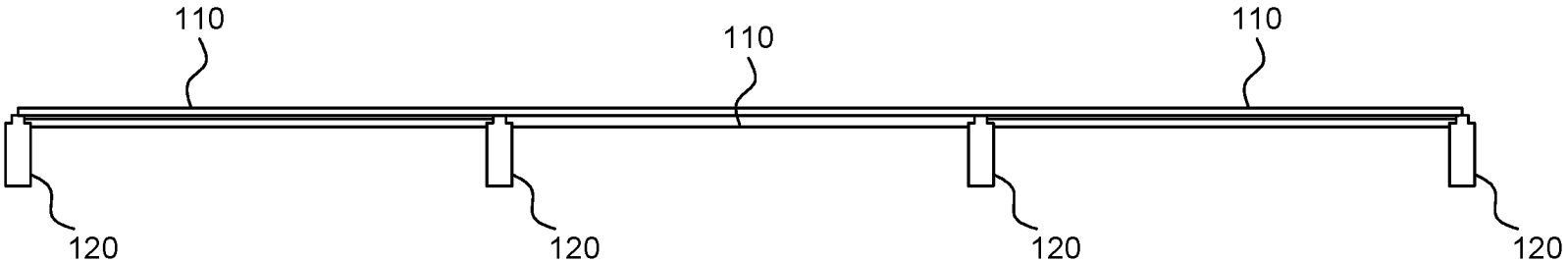
FIG. 2B is a front or rear view of the floor system of the present invention.

FIG. 2A shows a top view of the floor system 100 of FIG. 1. FIG. 2B shows a front or rear view of the floor system 100 of FIG. 1. FIG. 2C shows a side view of the floor system 100 of FIG. 1. The double plate floor panels 110 may be designed to span 10-30 ft. More specifically, the double plate floor panels 110 may be designed to span 16-24 ft. More specifically, the double plate floor panel may span 20 ft.

Figure 3:
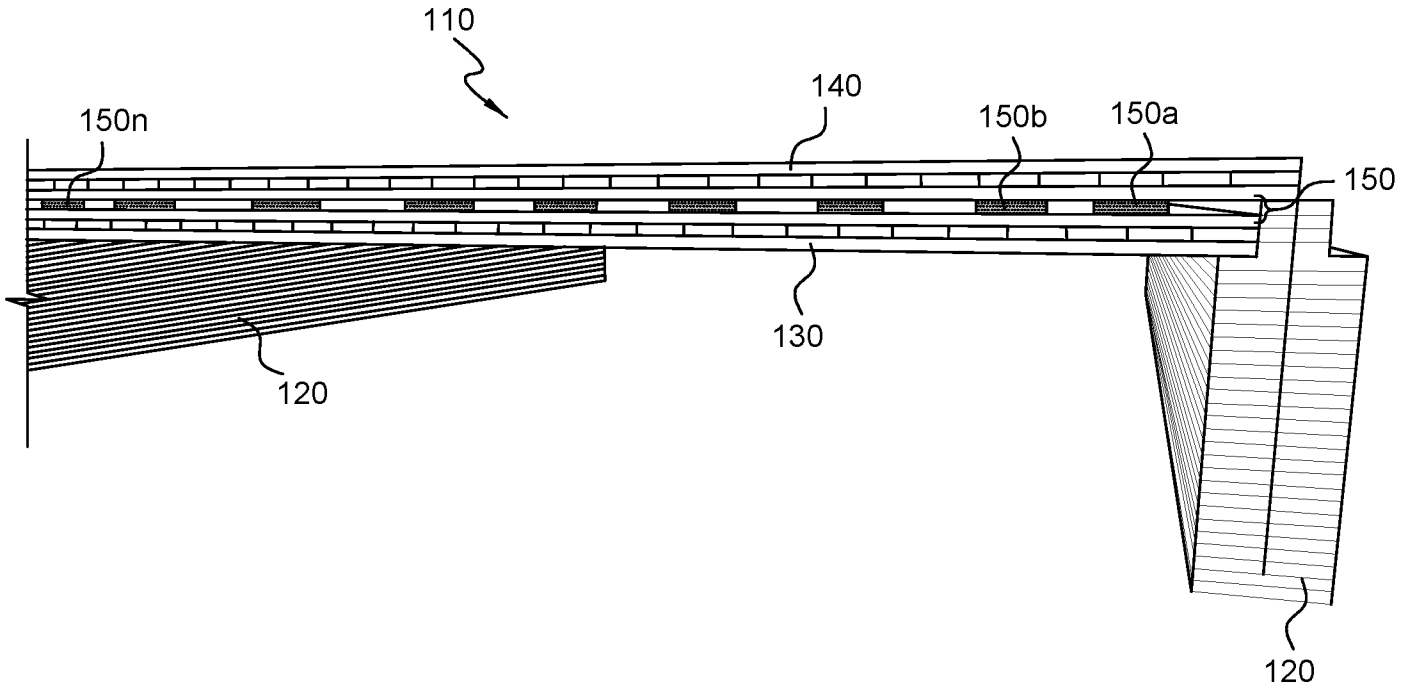
FIG. 3 is a front perspective view of a section of the floor system of the present invention.

FIG. 3 shows a front perspective view of a section of the floor system 100 of the present invention. The double plate floor panel 110 includes a first panel 130 and a second panel 140. The double plate floor panel 110 also includes a plurality of connectors 150*a-n* between the first panel 130 and the second panel 140. The first panel 130 and the second panel 140 may be made from cross laminated timber ("CLT"). The first panel 130 and the second panel 140 give the floor strength while the connectors 150*a-n* are configured to absorb and dissipate vibration. The first panel 130 and the second panel 140 may also be three-ply, as shown in FIG. 3, to increase stiffness and improve performance.

Figure 4:
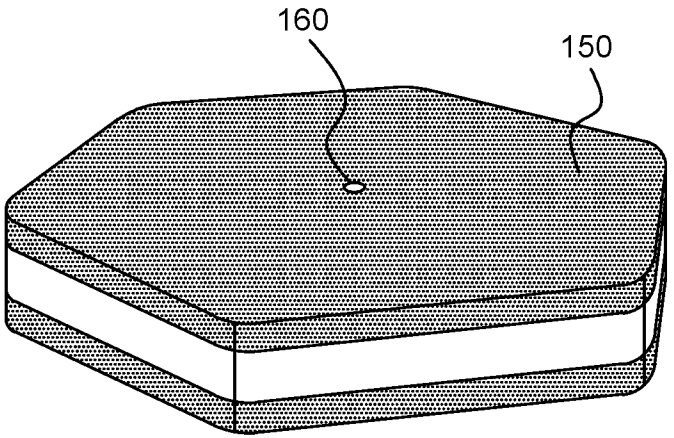
FIG. 4 is a perspective view of an exemplary connector of the present invention.

FIG. 4 shows a perspective view of a connector 150. The connector 150 may be a hexagon shape, as shown in FIG. 4, or a different geometric shape such as a rectangle or circle. The connector 150 has a degree of elasticity. The connector 150 is configured to absorb and decrease vibration in the floor system 100. To absorb and decrease vibration, the connector 150 may be made from a vibration-reducing material. The connector 150 may be made from a single material or a composite material. The composite material may include a substrate with at least one elastic layer. The plurality of connectors 150*a-n* may have varying degrees of elasticity or differing elastomeric resiliencies. The plurality of connectors 150*a-n* may have differing cross-section composites to create varying degrees of elasticity. The different elastic properties between the plurality of connectors 150*a-n* disrupts any vibrational modes. The connector 150 may also include an opening 160 through its center. The opening 160 may be configured to receive a pin to connect the first panel 130 and the second panel 140 through the connector 150. The connectors 150*a-n* may act in shear transfer.

Figure 5A:
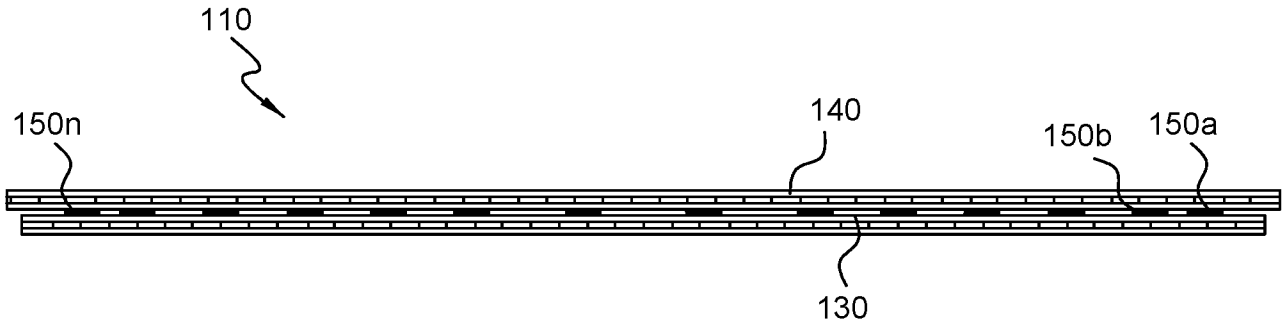
FIG. 5A is a front or rear view of a double plate floor panel of the present invention.
Figure 5B:
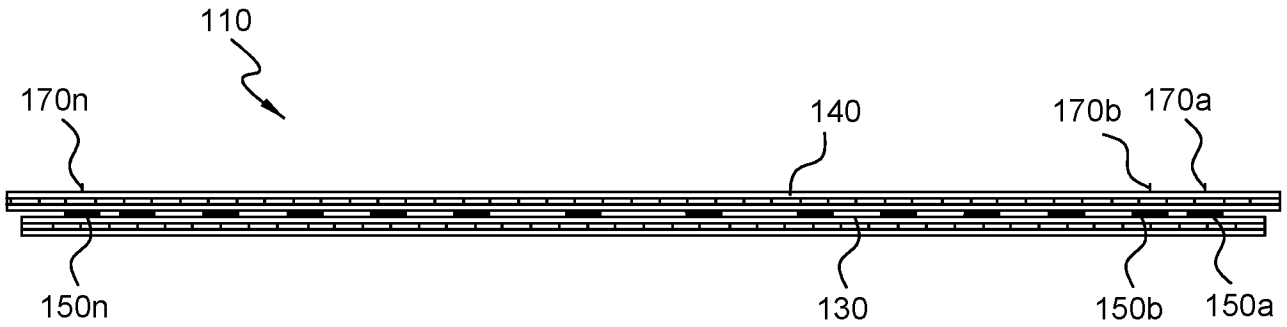
FIG. 5B is a front or rear view of a clamped double plate floor panel of the present invention.

FIG. 5A and FIG. 5B show a front or rear view of a double plate floor panel 110. The connectors 150*a-n* are spaced apart between the first panel 130 and the second panel 140. The distance between connectors 150*a-n* may vary, as shown in FIGS. 5A and 5B. There may be more distant between connectors 150*a-n* towards the approximate center of the double plate floor panel 110. The concealed space between connectors 150*a-n* enables routing of power and data and a non-combustible acoustic layer. FIG. 5A shows an unclamped double plate floor panel 110. FIG. 5B shows a clamped double plate floor panel 110. The clamped double plate floor panel 110 shown in FIG. 5B includes clamping mechanisms 170*a-n*, such as pins, that connect the first panel 130, the connectors 150*a-n*, and the second panel 140. The clamping mechanism 170*a-n* may insert through the second panel 140, through the connector 150, and into the first panel 130.

Figure 5C:
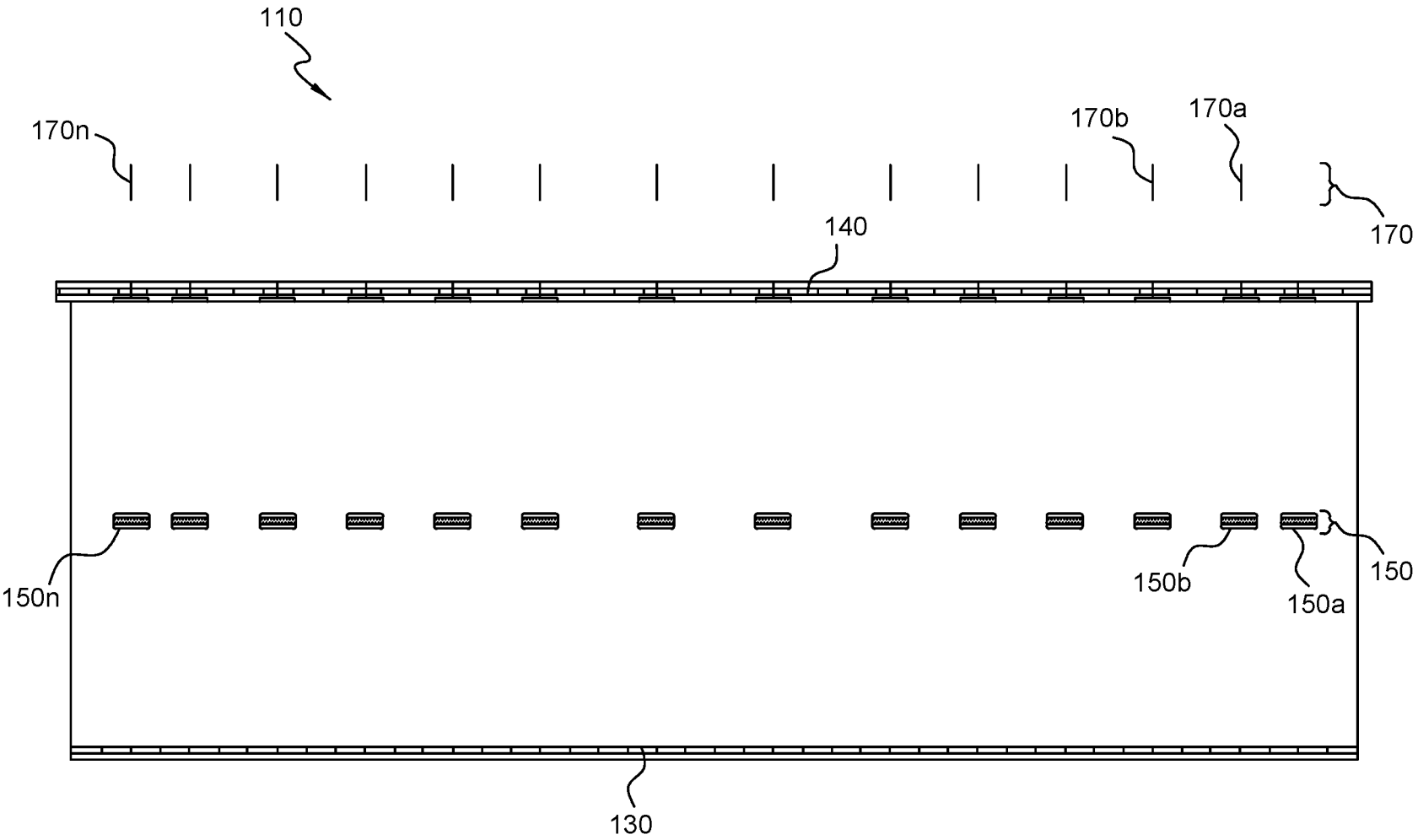
FIG. 5C is an exploded view of the clamped double plate floor panel of FIG. 5B.

FIG. 5C shows an exploded view of FIG. 5B. FIG. 5C illustrates the clamping mechanisms 170*a-n*, the first panel 130, the connectors 150*a-n*, and the second panel 140.

Figure 6A:
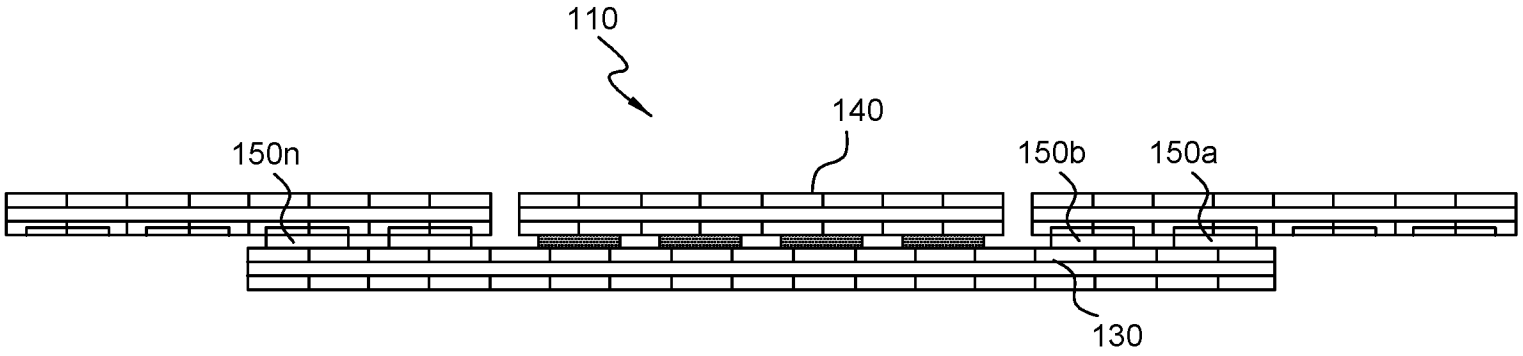
FIG. 6A is a left or right view of the double plate floor panel of the present invention.
Figure 6B:
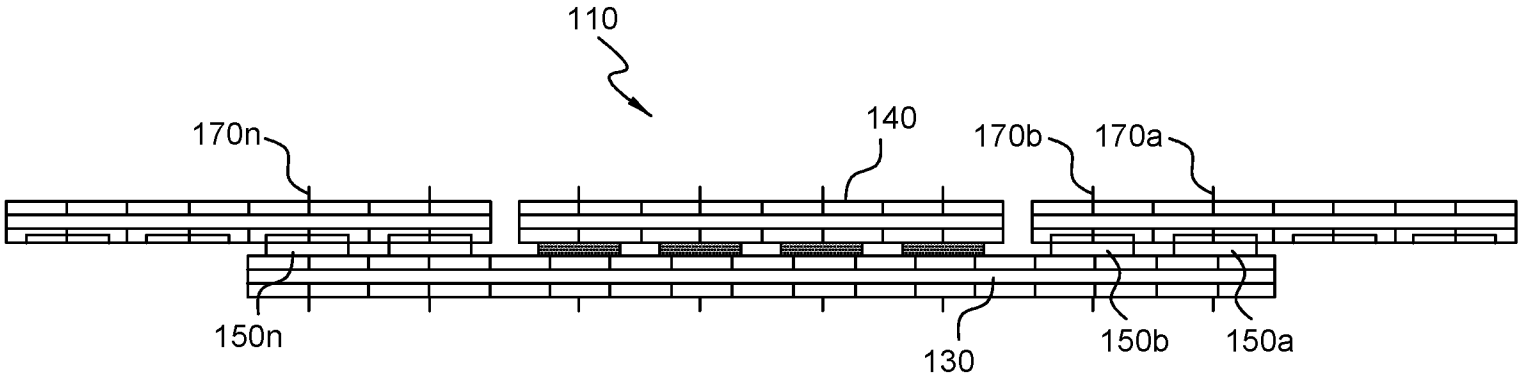
FIG. 6B is a left or right view of a clamped double plate floor panel of the present invention.

FIGS. 6A and 6B show a right or left side view of a double plate floor panel 110. The first panel 130 and the second panel 140 may comprise plates. The plates of the first panel 130 may be wider than the plates of the second panel 140. More specifically, the first panel 130 may comprise at least one 7.5 ft. wide plate, and the second panel 140 may comprise at least two 3.25 ft. wide plates. The 3.25 ft wide plates may be staggered over the 7.5 ft. wide plate as shown in FIGS. 6A and 6B to enable diaphragm splicing. The second panel 140 may also include diaphragms between the plates. FIG. 6A shows an unclamped double plate floor panel 110. FIG. 6B shows a clamped double plate floor panel 110.

Figure 6C:
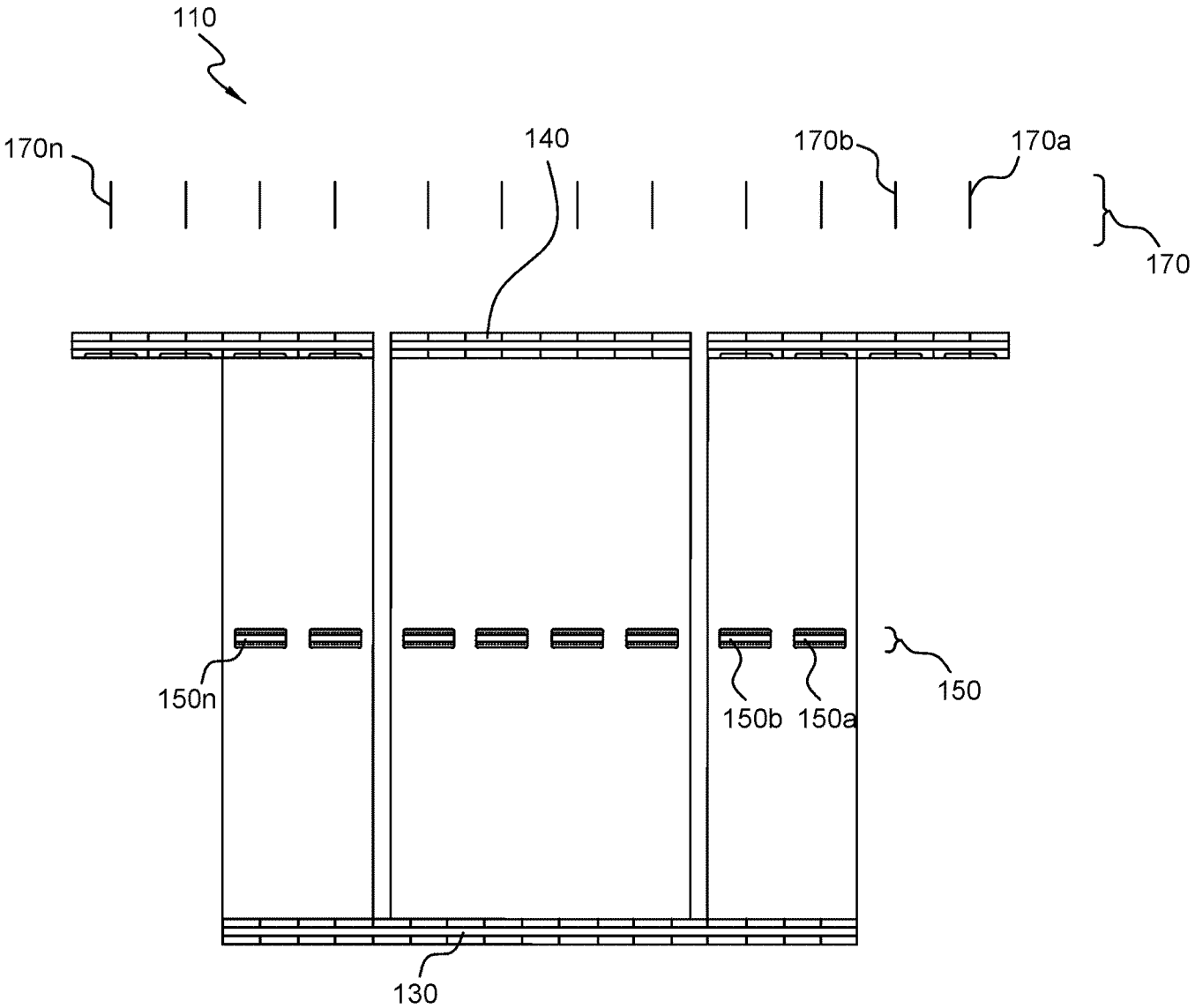
FIG. 6C is an exploded view of the clamped double plate floor panel of FIG. 6B.
Figure 7A:
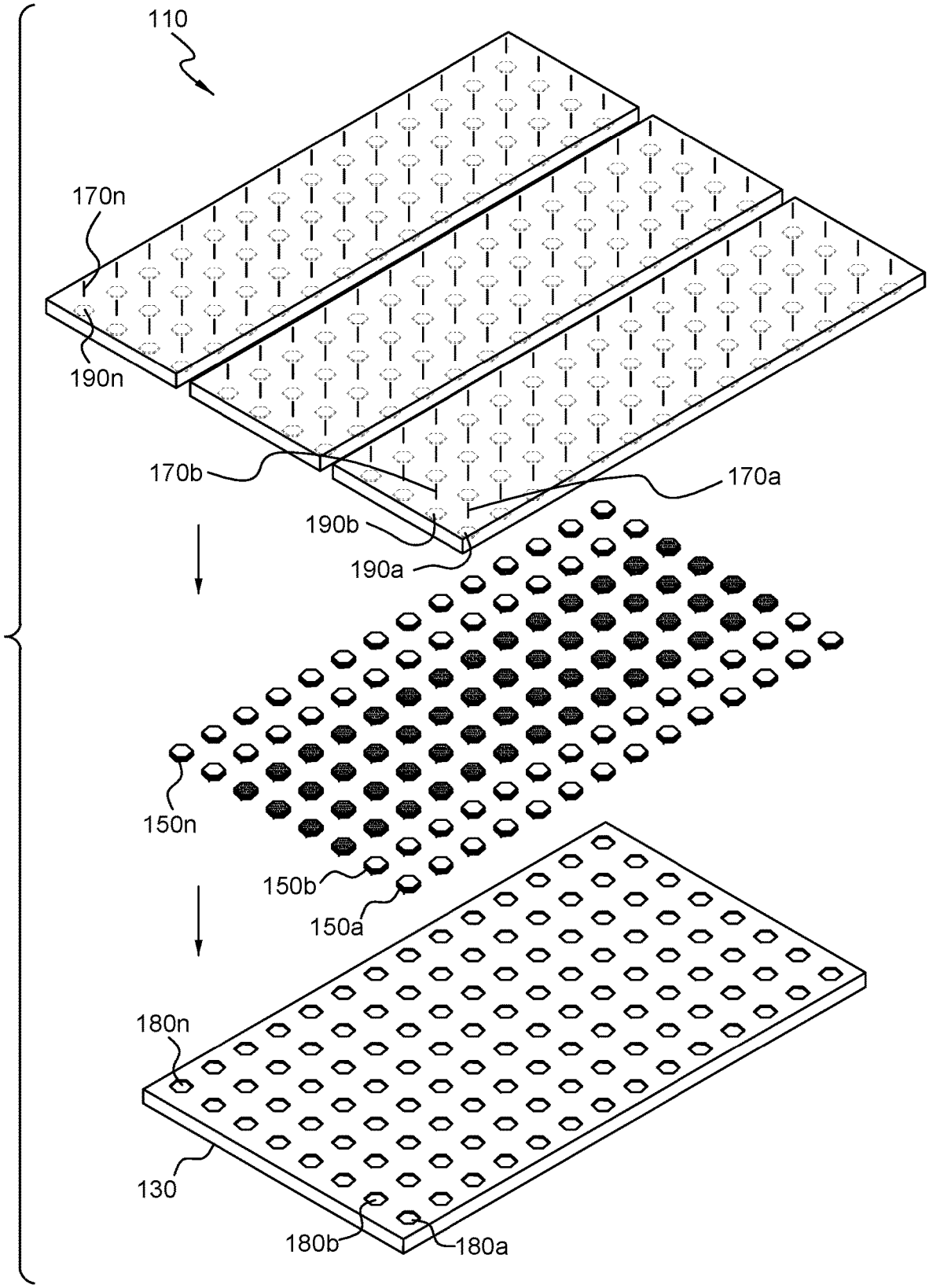
FIG. 7A is a left or right perspective exploded view of the clamped double plate floor panel of the present invention.
Figure 7B:
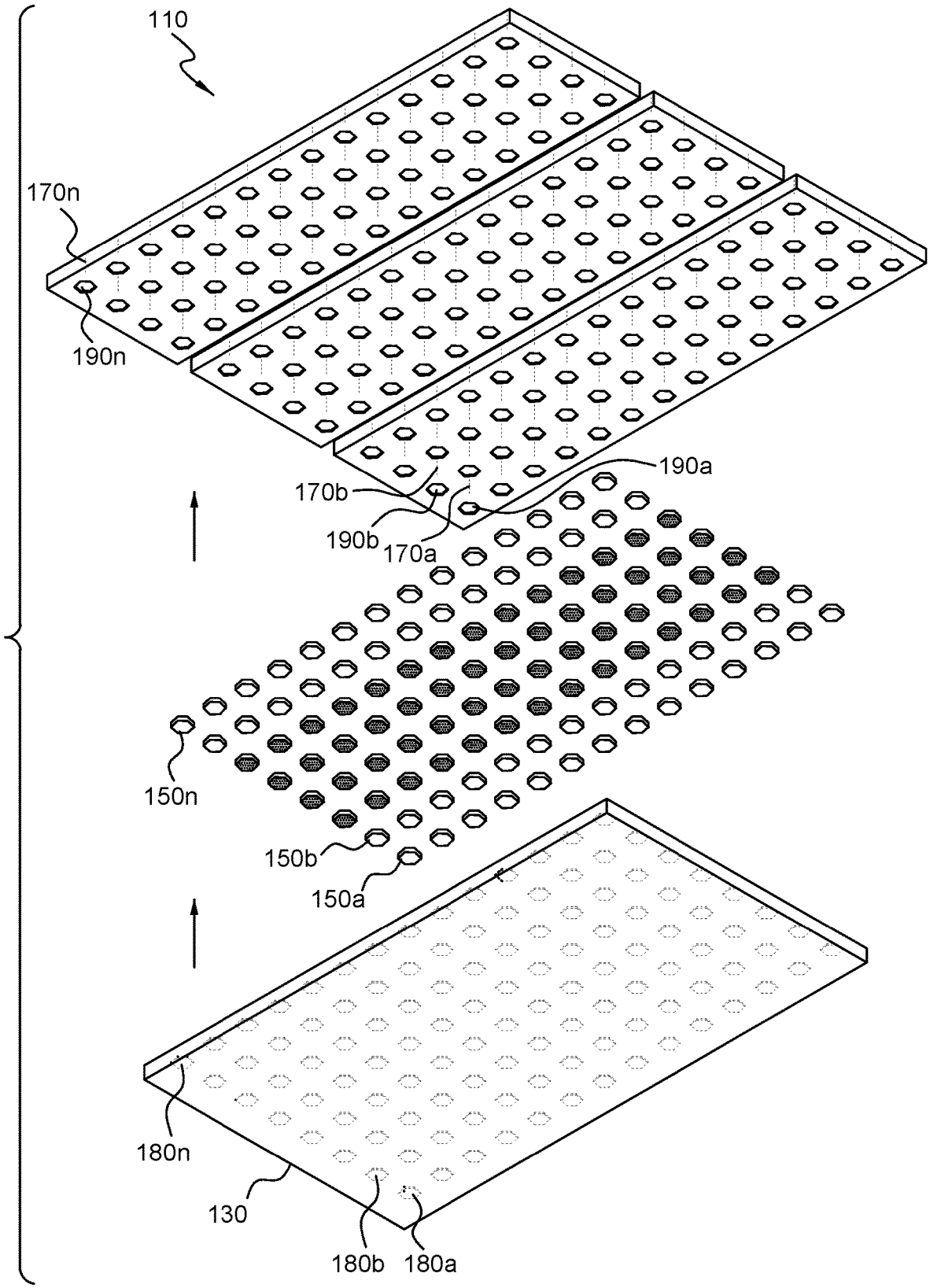
FIG. 7B is an alternative left or right perspective exploded view of the clamped double plate floor panel of the present invention.
Figure 7C:
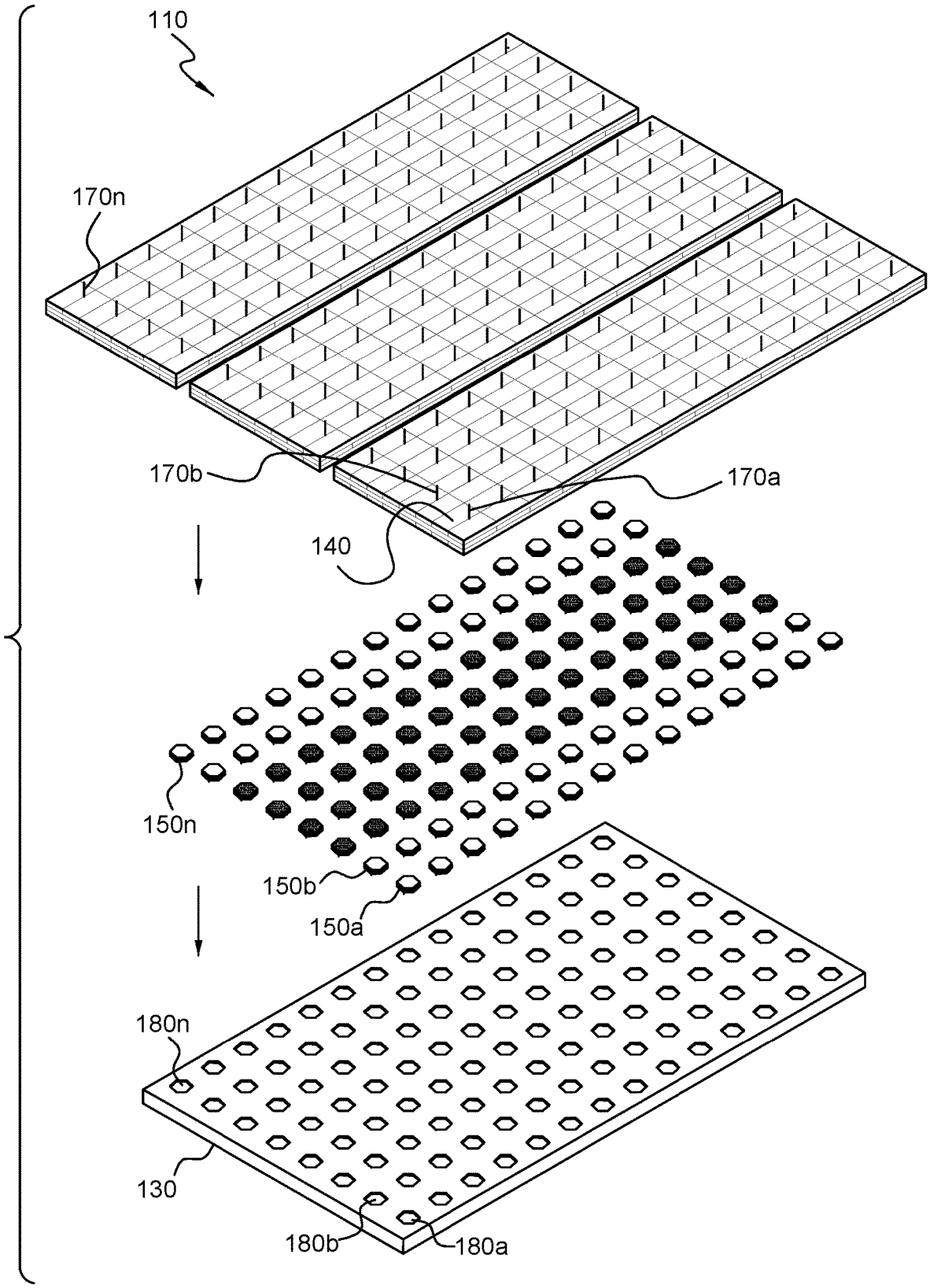
FIG. 7C is a front or rear perspective exploded view of the clamped double plate floor panel of the present invention.
Figure 7D:
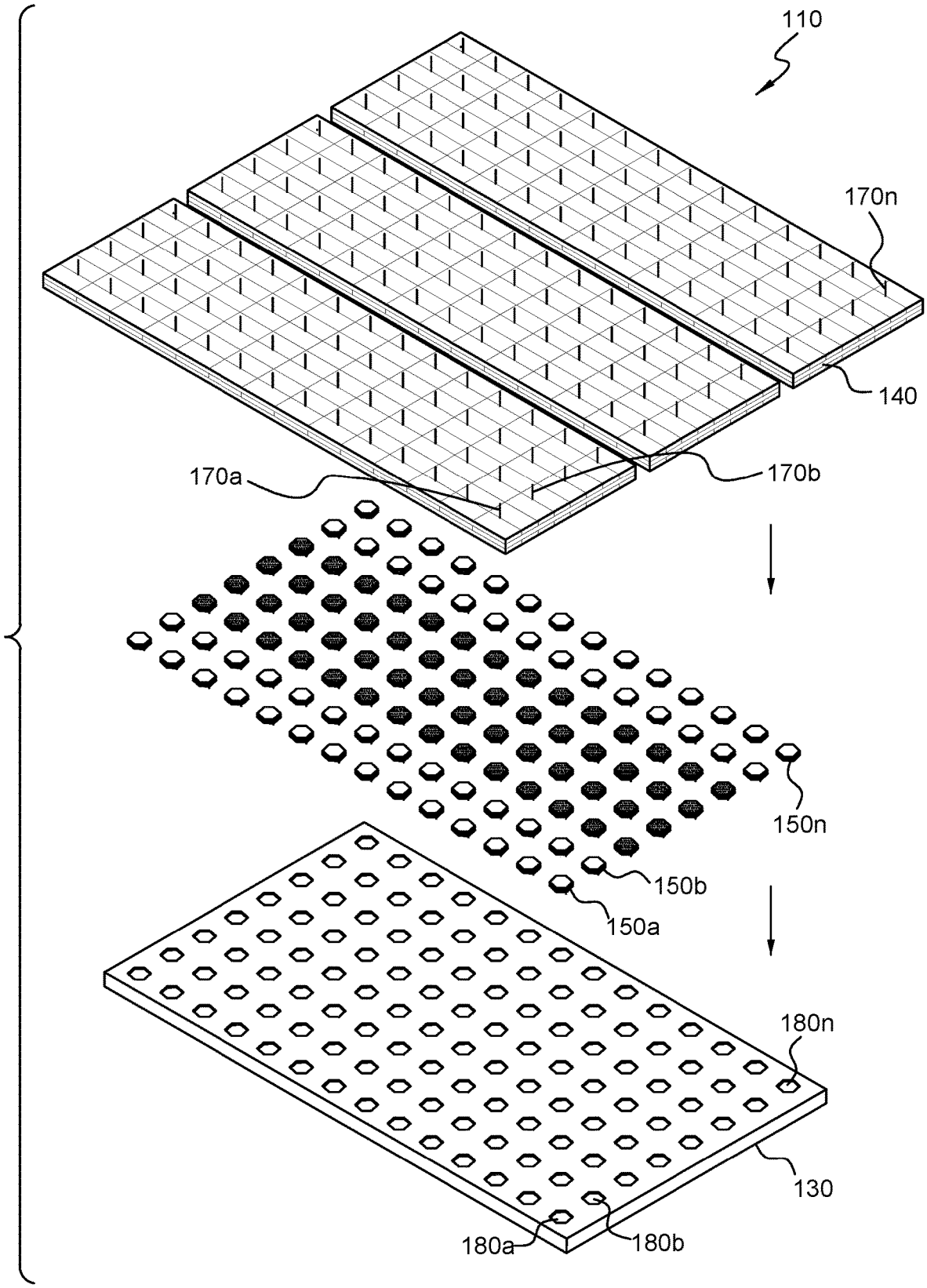
FIG. 7D is a front right perspective exploded view of the clamped double plate floor panel of the present invention.

FIG. 6C shows an exploded view of FIG. 6B. FIG. 6C shows the clamping mechanisms 170*a-n*, the first panel 130, the connectors 150*a-n*, and the second panel 140.

FIGS. 7A, 7B, 7C, and 7D show exploded, perspective views of a double plate floor panel 110. FIG. 7A-7D show the clamping mechanisms 170*a-n*, the first panel 130, the connectors 150*a-n*, and the second panel 140. The first panel 130 includes a first plurality of recesses 180*a-n* in the first or top surface. The second panel 140 includes a second plurality of recesses 190*a-n* in the second or bottom surface. The recesses 180*a-n*, 190*a-n* are sized and shaped to fit a connector 150. Each connector 150*a-n* fits into a recess 180*a-n* in the first panel 130 and a recess 190*a-n* in the second panel 140. The connectors 150 connect the first panel 130 to the second panel 140. Although the figures illustrate hexagon shaped connectors 150*a-n*, the connectors 150*a-n* may be any geometric shape. The size and shape of the first plurality of recesses 180*a-n* and the second plurality of recesses 190*a-n* correspond to the size and shape of the connectors 150*a-n*.

The combination connectors 150*a-n*, first panel 130, and second panel 140 provide a cost-effective means to build a floor system 100 that reduces vibration issues. The double plate floor panel 110 may be a dry solution meaning there is no need for a topping slab for acoustic or vibration performance. The double plate floor panel 110 enables improved vibration and fire performance. The double plate floor panel 110 may have better performance than a single plate assembly with a topping slab.

Figure 8A:
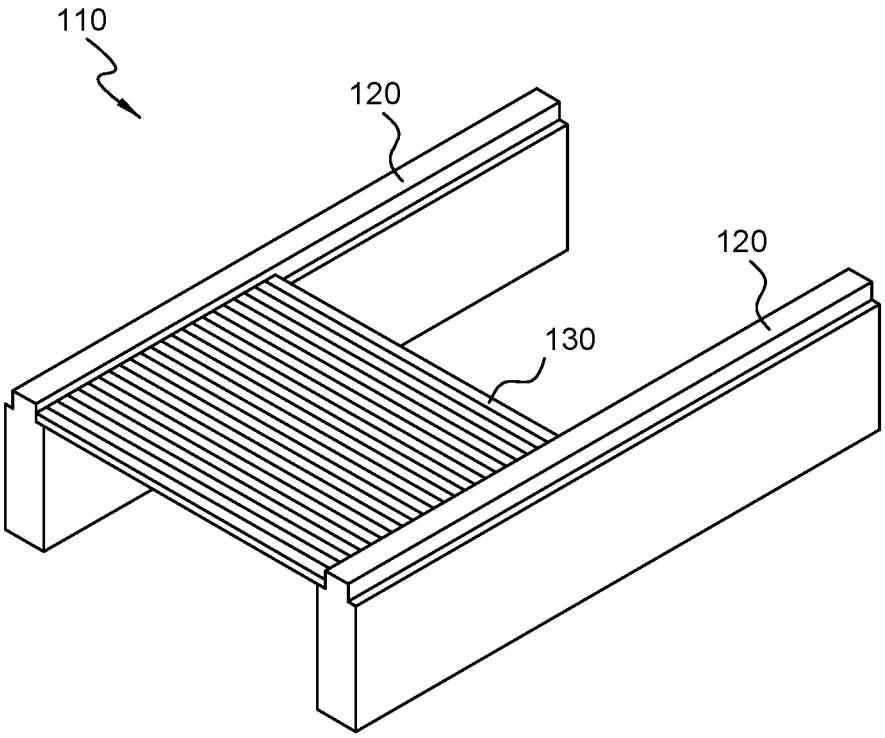
FIG. 8A is a perspective view of the first panel of the double plate floor panel installed to beams in accordance with the present invention.
Figure 8B:
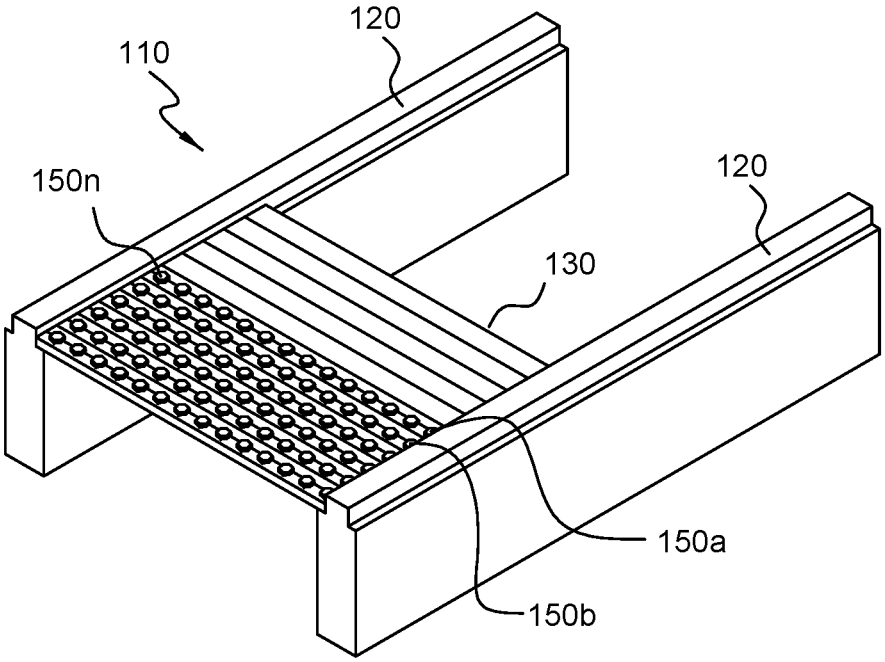
FIG. 8B is a perspective view illustrating connectors installed to the first panel of the double plate floor panel of the present invention.
Figure 8C:
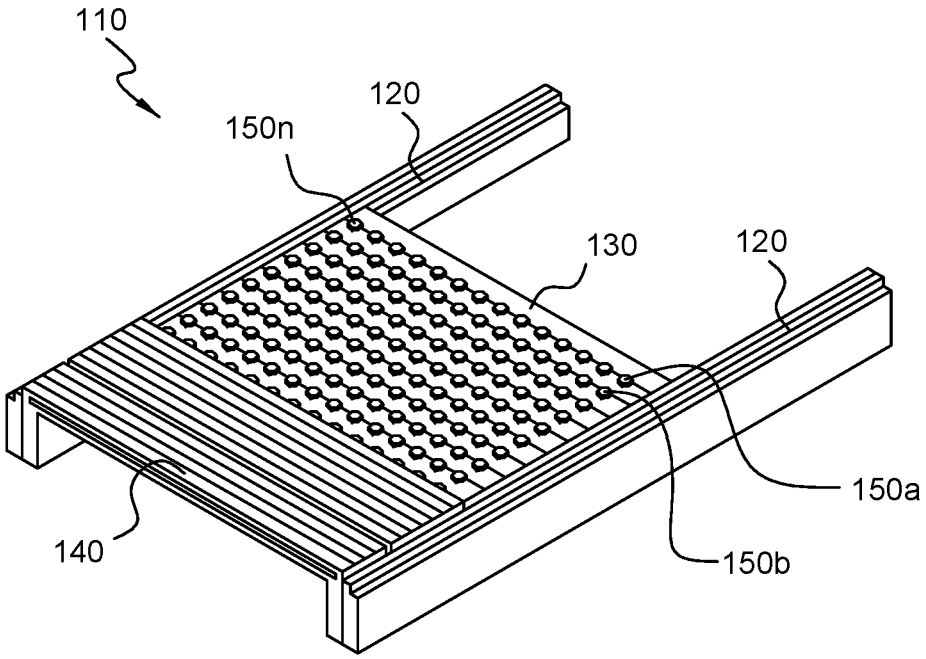
FIG. 8C is a perspective view of second panels installed onto the first panel of the double plate floor panel of the present invention.
Figure 8D:
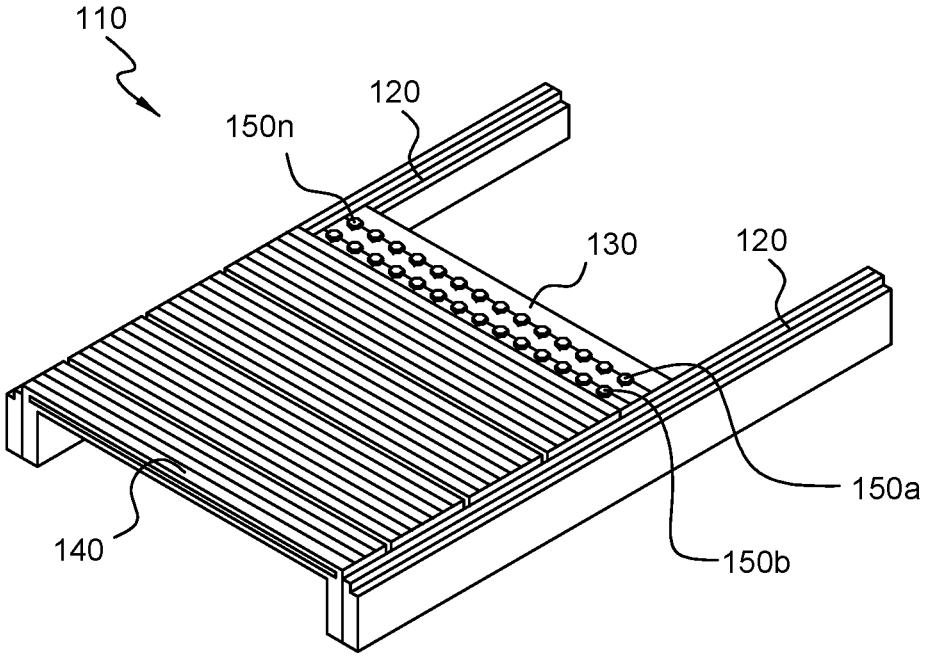
FIG. 8D is a perspective view of second panels installed onto the first panel of the double plate floor panel of the present invention; and, FIG. 9 is a flow chart depicting a method of assembling a double plate floor panel.

As shown in FIG. 8A, the double plate floor panel 110 is constructed by installing the first panel 130. The first panel 130 may be installed between beams 120 with opposite ends of the first panel 130 supported by the beams 120. The connectors 150*a-n* are installed in the first plurality of recesses 180*a-n* (not visible in FIG. 8A-8C) in the top surface of the first panel 130, as shown in FIG. 8B. The second panel 140 is then installed over the plurality of connectors 150*a-n* and the first panel 130 as shown in FIGS. 8C and 8D. The second plurality of recesses 190*a-n* (not visible in FIG. 8A-8D) align with the connectors 150*a-n* and first plurality of recesses 180*a-n*. Although not shown, the clamping mechanisms 170*a-n* may be installed by inserting the mechanism through the top of the second panel 140, through the connector 150, and into the first panel 130.

Figure 9:
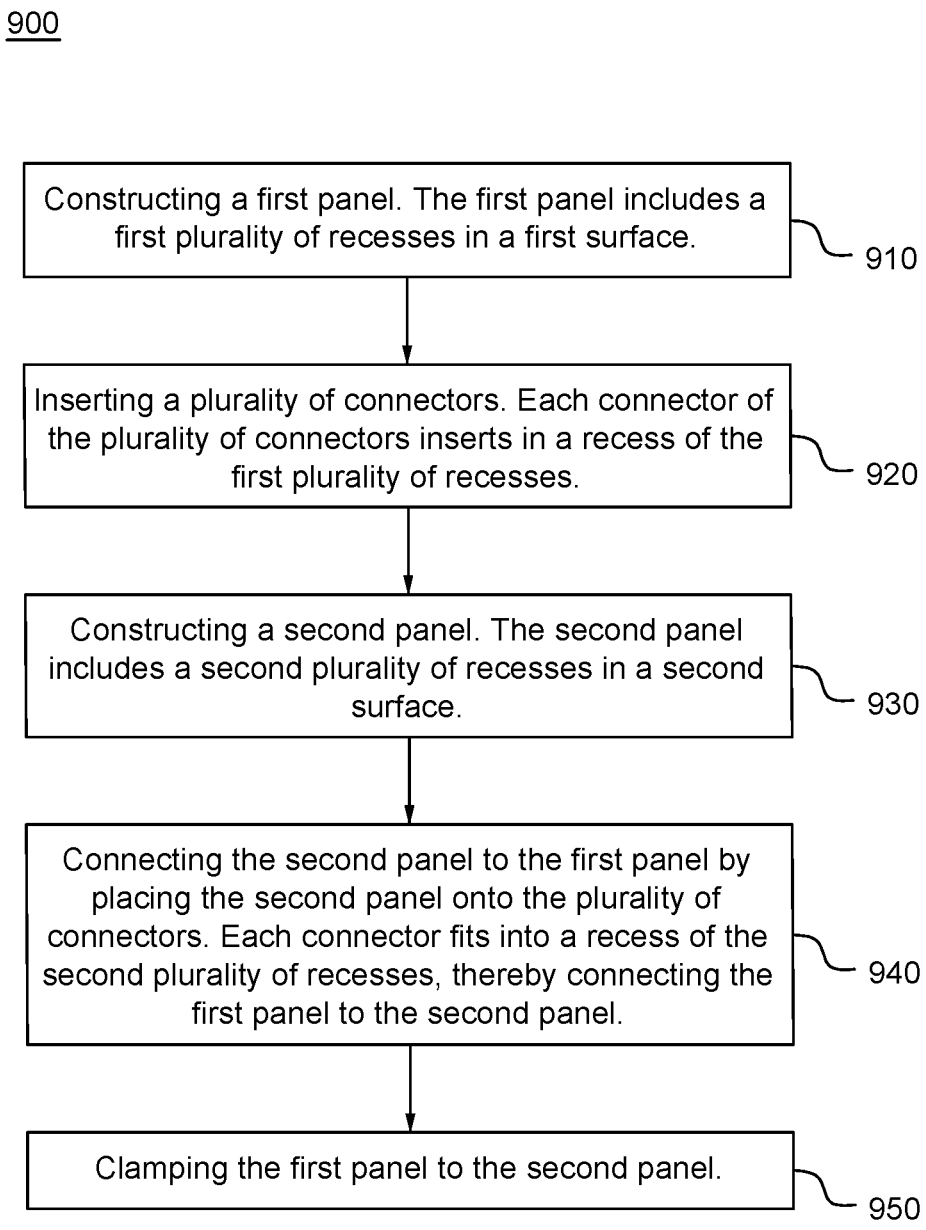

A method of assembling a double plate floor panel 1000 is provided according to the flow chart in FIG. 9. At the first step 910, a first panel is constructed. The first panel 130 includes a plurality of recesses 180*a-n* in a first surface. At the second step 920, a plurality of connectors 150*a-n* is inserted in the first panel 130. Each connector 150 of the plurality of connectors 150*a-n* is inserted in a recess 180 of the first plurality of recesses 180*a-n*. At a third step 930, a second panel 140 is constructed. The second panel 140 includes a second plurality of recesses 190*a-n* in a second surface. At a fourth step 940, the second panel 140 is connected to the first panel 130 by installing the second panel 140 onto the connectors 150*a-n* that are inserted in the first panel 130. Each connector 150 of the plurality of connectors 150*a-n* fits into a recess 190 of the second plurality of recesses 190*a-n* in the second panel 140. At a fifth step 950, the first panel 130 and the second panel 140 may be clamped. The first panel 130 and the second panel 140 may be clamped by inserting a clamping mechanism 170*a-n* through the second panel 140, through the connector 150, and into the first panel 130. The components of the double plate floor panel 110 include the details and embodiments previously described herein. The double plate floor panel 100 may be prefabricate in a factory or assembled at its final location.

Having thus described in detail a preferred selection of embodiments of the present invention, it is to be appreciated and will be apparent to those skilled in the art that many physical changes could be made to the double plate floor panel 110 without altering the inventive concepts and prin-ciples embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A floor system comprising:

a first panel including a first plurality of recesses in a first side;

a second panel including a second plurality of recesses in a second side, the second side facing the first side, and the second plurality of recesses aligning with the first plurality of recesses; and a plurality of connectors sandwiched between the first plurality of recesses and the second plurality of recesses to couple the first panel to the second panel, each connector comprising a vibration-reducing material to lessen in the second panel motion that occurs in the first panel.

2. The floor system of claim 1, wherein the first plurality of recesses, the second plurality of recesses, and the plurality of connectors are hexagon shaped.

3. The floor system of claim 1, wherein the distance varies between adjacent connectors of the plurality of connectors.

4. The floor system of claim 1, wherein there is concealed space between the connectors.

5. The floor panel system of claim 1, wherein the vibration-reducing material of the connectors comprises a composite material.

6. The floor system of claim 5, wherein the composite material includes a substrate with at least one elastic layer.

7. The floor panel system of claim 1, wherein the vibration-reducing material of the connectors varies in degree of elasticity between connectors.

8. The floor system of claim 7, wherein the vibration-reducing material of the connectors that varies in degree of elasticity between connectors comprises differing cross-sectional composites.

9. The floor system of claim 8, wherein the differing cross-sectional composites have differing elastomeric resiliencies.

10. The floor panel system of claim 1, wherein each connector further comprises a clamping mechanisms for connecting together the first panel and the second panel.

11. The floor panel system of claim 10, wherein connector comprises an opening to receive a clamping mechanism.

12. The floor panel system of claim 10, wherein the plurality of camping mechanisms are pins.

13. A method of assembling a double floor panel system, comprising:

constructing a first panel, the first panel including a first plurality of recesses in a first surface;

inserting a plurality of connectors, each connector of the plurality of connectors inserts in a recess of the first plurality of recesses;

constructing a scoff panel opposite the first panel, the scoff panel including a second plurality of recesses in a second surface; and connecting the second panel to the first panel by inserting the plurality of connectors, each connector of the plurality of connectors inserts in a recess of the second plurality of recesses, wherein each connector comprises a vibration-reducing material to lessen in the second panel any motion that occurs in the first panel.

14. The method of claim 13, additionally comprising the step of inserting clamping mechanisms in the form of pins through the second panel, through the plurality of connectors, and into the first panel to connect the first panel and the second panel through the plurality of connectors to provide a clamped double floor panel system.

15. The method of claim 13, wherein constructing the second panel further including connecting a plurality of 3.25 ft. cross laminated timber plates with a diaphragm between each plate of the plurality of 3.25 ft. cross laminated timber plates.

16. The method of claim 13, additionally comprising the step of installing the first panel between beams with opposite ends of the first panel supported by the beams.

17. A floor system comprising:

one or more double plate floor panels, each double plate floor panel including a first panel including a first plurality of recesses in a first side, a second panel including a second plurality of recesses in a second side, the second side facing the first side, and the second plurality of recesses aligning with the first plurality of recesses, a plurality of connectors sandwiched between the first plurality of recesses and the second plurality of recesses to couple the first panel to the second panel, each connector comprising a vibration-reducing material to lessen in the second panel any motion that occurs in the first panel, and, two or more support beams provided to support the at least one double plate floor panel at its opposite ends.

18. The floor system of claim 17, wherein the one or more double plate floor panel comprises three double plate floor panels laid end to end, and wherein the two or more support beams comprises four support beams arranged to support the three double plate floor panels at their opposite ends.

* * * * *